US005580302A

United States Patent [19]

Howard, Jr. et al.

[11] Patent Number: 5,580,302

[45] Date of Patent: Dec. 3, 1996

[54] RANDOM ORBIT SANDER HAVING AIR DIRECTING BAFFLE

[75] Inventors: Thomas J. Howard, Jr., Whitehall; David L. Sutton, Forest Hill, both of Md.

[73] Assignee: Black & Decker Inc., Newark, Del.

[21] Appl. No.: 203,131

[22] Filed: Feb. 28, 1994

[51] Int. Cl.[6] ..... B24B 23/03

[52] U.S. Cl. ..... 451/357; 451/456

[58] Field of Search ..... 451/451, 453, 451/456, 449, 359, 357, 344

[56] References Cited

U.S. PATENT DOCUMENTS

| | | | |
|---|---|---|---|
| 4,322,921 | 4/1982 | Maier | 451/357 |
| 4,381,628 | 5/1983 | Dicke | 451/456 |
| 4,531,329 | 7/1985 | Huber | 451/456 |
| 4,624,078 | 11/1986 | Van Rijen et al. | 451/357 |
| 4,660,329 | 4/1987 | Hutchins | 451/357 |
| 4,727,682 | 3/1988 | Stäbler et al. | 451/271 |
| 4,729,195 | 3/1988 | Berger | 451/357 |
| 4,754,575 | 7/1988 | Schneider | 451/271 |
| 4,759,152 | 7/1988 | Berger et al. | 451/271 |
| 5,018,314 | 5/1991 | Fushiya et al. | 451/357 |
| 5,261,190 | 11/1993 | Berger et al. | 451/357 |
| 5,311,089 | 5/1994 | Stroetgen et al. . | |
| 5,315,193 | 5/1994 | Kummer et al. . | |
| 5,384,984 | 1/1995 | Smith | 451/357 |

FOREIGN PATENT DOCUMENTS

| | | | |
|---|---|---|---|
| 0230621 | 8/1987 | European Pat. Off. . | |
| 0138278 | 6/1988 | European Pat. Off. . | |
| 0320599 | 6/1989 | European Pat. Off. . | |
| 0559020 | 9/1993 | European Pat. Off. . | |
| 1189405 | 11/1965 | Germany . | |
| 3048519 | 7/1982 | Germany . | |
| 3533668 | 3/1987 | Germany . | |
| 3625671 | 1/1988 | Germany . | |
| 3625535 | 2/1988 | Germany . | |
| 4023464 | 1/1992 | Germany . | |
| 0747700 | 7/1980 | U.S.S.R. | 451/453 |
| 2191429 | 12/1987 | United Kingdom . | |
| WO8909114 | 10/1989 | WIPO . | |

*Primary Examiner*—Robert A. Rose

*Attorney, Agent, or Firm*—Harness, Dickey & Pierce, P.L.C.

[57] ABSTRACT

An air directing baffle for a random orbit sander. The baffle includes a main body portion forming an annular opening, a pair of neck portions extending approximately circumferentially opposite from one another, and a pair of recessed portions formed in each of the neck portions. The neck portions extend into airflow registration with a plurality of exhaust slots formed in a shroud rotatably disposed at a lower portion of a housing of the sander. The annular opening is adapted to fit over a boss portion protruding from a lower face surface of the housing of the sander to thus permit the baffle to be rotated freely relative to the housing. The recessed portions in each of the neck portions of the baffle inwardly engage with a pair of inwardly protruding shoulder portions formed in an interior area of the shroud. The interengagement of the baffle with the shroud permits the neck portions of the baffle to be maintained in alignment with the exhaust slots in the shroud as the shroud is rotated by a user during operation of the sander. Thus, the baffle is free to rotate relative to the housing but not relative to the shroud itself. The baffle serves to more effectively direct a cooling airflow drawn in by a fan through inlet slots in a top member associated with the housing such that the airflow is more directly exhausted from the interior area of the shroud. The design of the baffle further does not complicate the assembly of the sander 10 or otherwise add significantly to the overall cost of the sander.

15 Claims, 2 Drawing Sheets

RANDOM ORBIT SANDER HAVING AIR DIRECTING BAFFLE

BACKGROUND OF THE INVENTION

1. Technical Field

This invention relates to power sanders, and more particularly to a random orbit sander having an air directing baffle disposed therein for helping to exhaust a cooling airflow flowing through an interior area of the sander, to thus help better cool a motor disposed therein.

2. Discussion

Random orbit sanders are used in a wide variety of applications such as woodworking and auto body repair work. Such sanders typically employ a housing, a motor disposed within the housing, a shaft operably coupled to the motor, a shroud coupled to the housing for supporting and communicating with a dust bag (attached hereto), and a fan operably coupled to the motor shaft for drawing a cooling airflow in through openings in the housing and exhausting the cooling air flow through openings in the shroud to help cool the motor. The shroud is preferably rotatably coupled to the housing to enable the dust bag thereof to be rotated out of the way by the user to enable convenient use of the sander.

With random orbit sanders such as described above, however, the cooling airflow drawn in through the openings in the housing is not most efficiently exhausted out of the openings in the shroud due to a lack of some structure within the shroud for directing the air flow out of the shroud. Thus, the cooling airflow is typically allowed to circulate within the shroud somewhat before being exhausted through the shroud openings. Moreover, the lack of structure more closely defining an airflow path out of the openings in the shroud somewhat degrades the strength of the suction force generated by the fan, and therefore the airflow that is drawn in through the openings in the housing.

SUMMARY OF THE INVENTION

It is therefore a principal object of the present invention to provide a baffle for a random orbit sander which serves to more efficiently and effectively exhaust a cooling airflow drawn in through the openings in an upper area of a housing thereof out of a shroud of such a sander, to thereby more effectively help to cool a motor disposed within the sander.

It is yet another object of the present invention to provide a baffle for a random orbit sander such as described above which permits the shroud to be rotated as needed to enable convenient operation of the sander while maintaining the alignment of the baffle relative to the openings in the shroud. In this manner the cooling airflow path defined in part by the baffle is not interrupted or otherwise inhibited by rotational movement of the shroud relative to the housing. More specifically, it is an object of the present invention to provide a baffle which rotates freely in accordance with rotational movement of the shroud as the shroud is moved rotationally relative to the housing of the sander, but which does not move rotationally relative to the shroud.

It is yet a further object of the present invention to provide a baffle for a random orbit sander which is relatively simple and inexpensive to construct and which does not unduly complicate the assembly process during manufacture of the sander, or otherwise add appreciably to the cost of the sander.

The above and other objects are provided by a sander having an air directing baffle in accordance with a preferred embodiment of the present invention. The sander for which the air directing baffle is used is a random orbit sander having a housing, a top member, a plurality of inlets formed in the top member, a motor disposed within the housing, a shaft operably coupled with the armature of the motor, a fan disposed closely adjacent a lower end portion of the housing and operably coupled to the shaft so as to be driven by the motor, and a shroud for supporting a dust bag, with the shroud having at least one outlet therein and adapted to substantially enclose the fan.

The baffle of the present invention includes a main body portion forming an annular opening. The annular opening is adapted to fit over a central, generally circular boss portion of the housing so as to permit the baffle to be moved freely rotationally relative to the housing. The baffle further includes at least one neck portion extending from the main body portion. The neck portion is positioned during assembly so as to register with the opening in the shroud.

In the preferred embodiment the neck portion includes a recessed portion adapted to engage with an inwardly protruding shoulder portion of the shroud such that rotational movement of the shroud relative to the lower portion of the housing causes a corresponding rotational movement of the baffle. The inter-engagement of the neck portion with the inwardly protruding shoulder portion of the shroud prevents rotational movement of the baffle relative to the shroud itself. In this manner the shroud may be rotated by the user of the sander as needed to enable convenient operation without disrupting the alignment of the baffle relative to the shroud.

The baffle of the present invention provides a more clearly defined airflow exhaust path through which air drawn in through the inlet in the top member by the fan may be easily exhausted through the outlets in the shroud. The better defined airflow exhaust path enables the cooling air flow to more efficiently cool the motor. Without the baffle, air drawn into the shroud is free to circulate to some degree within the interior area defined by the shroud, thus somewhat impeding the exhaust of the airflow and thereby reducing the effectiveness of the cooling airflow in helping to cool the motor.

The preferred embodiments of the baffle are easily formed such as by injection molding or other widely practiced manufacturing techniques from widely available materials such as plastic. Accordingly, the baffle is relatively simple and inexpensive to produce. The baffle further does not significantly complicate the assembly process of the sander, nor otherwise significantly increase the overall cost of the sander. Thus, the baffle of the present invention provides a simple, relatively inexpensive yet effective means for more efficiently exhausting a cooling airflow from an interior area of the shroud, thereby enhancing the ability of an internally disposed fan to cool the motor of such a sander.

BRIEF DESCRIPTION OF THE DRAWINGS

The various advantages of the present invention will become apparent to one skilled in the art by reading the following specification and Subjoined claims and by referencing the following drawings in which:

Figure 2:
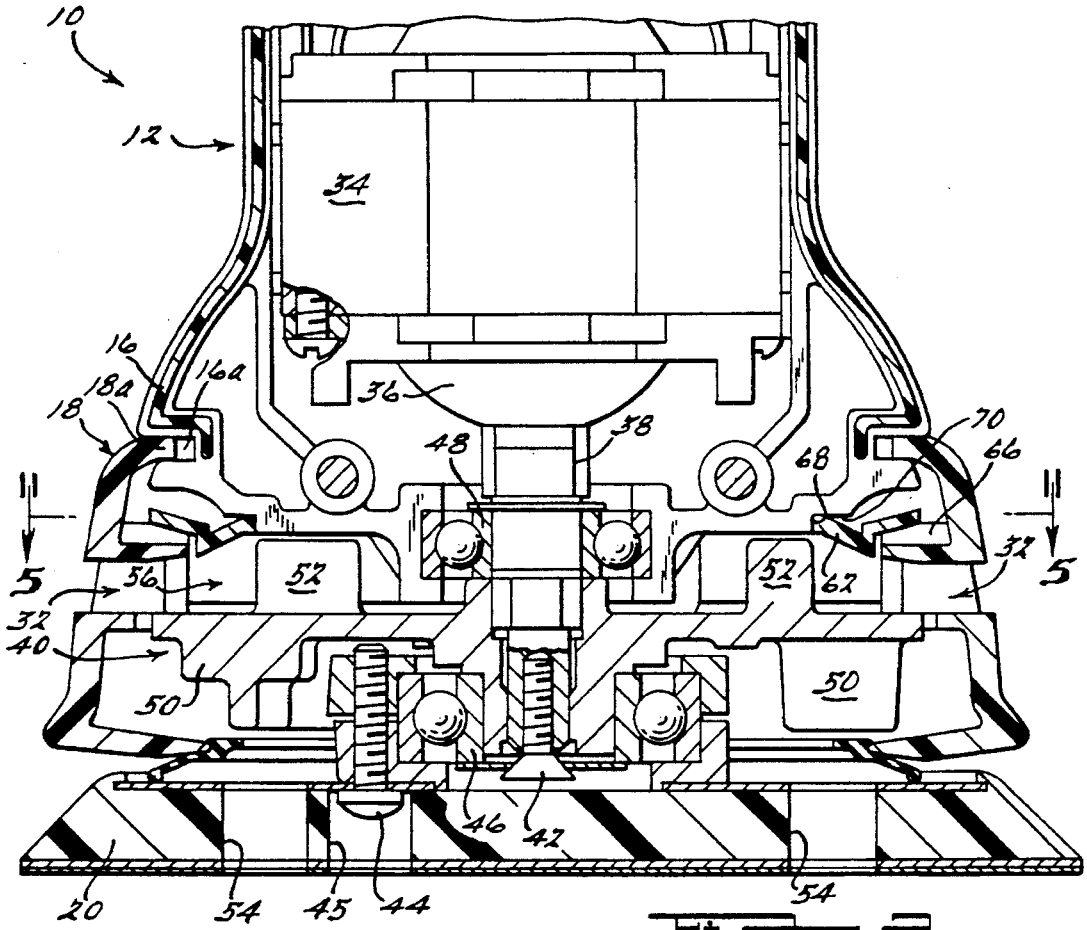
FIG. 2 is a partial cross sectional side view of the sander of FIG. 1 in accordance with section line 2—2 in FIG. 1 showing a preferred embodiment of a baffle in accordance with the present invention.
Figure 3:
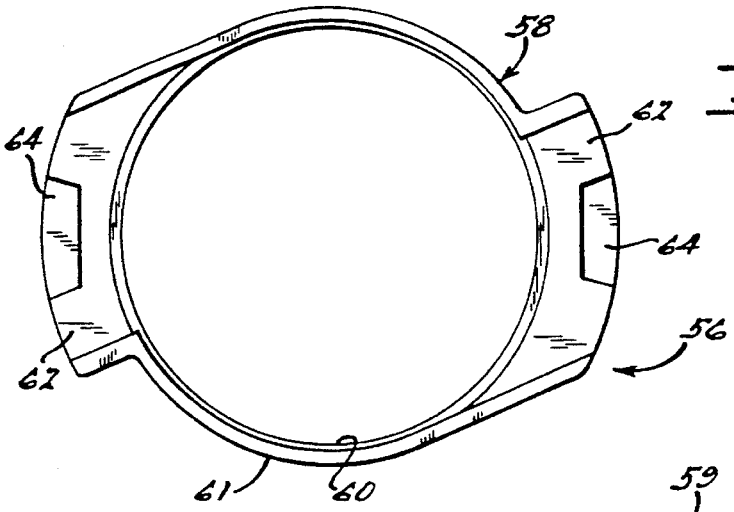
Figure 4:
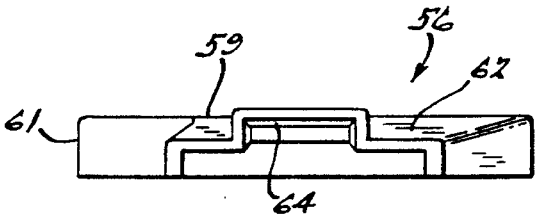

FIG. 3 is a bottom view of the baffle of FIG. 2;

FIG. 4 is an elevational side view of the baffle shown in FIG. 2; and

Figure 5:
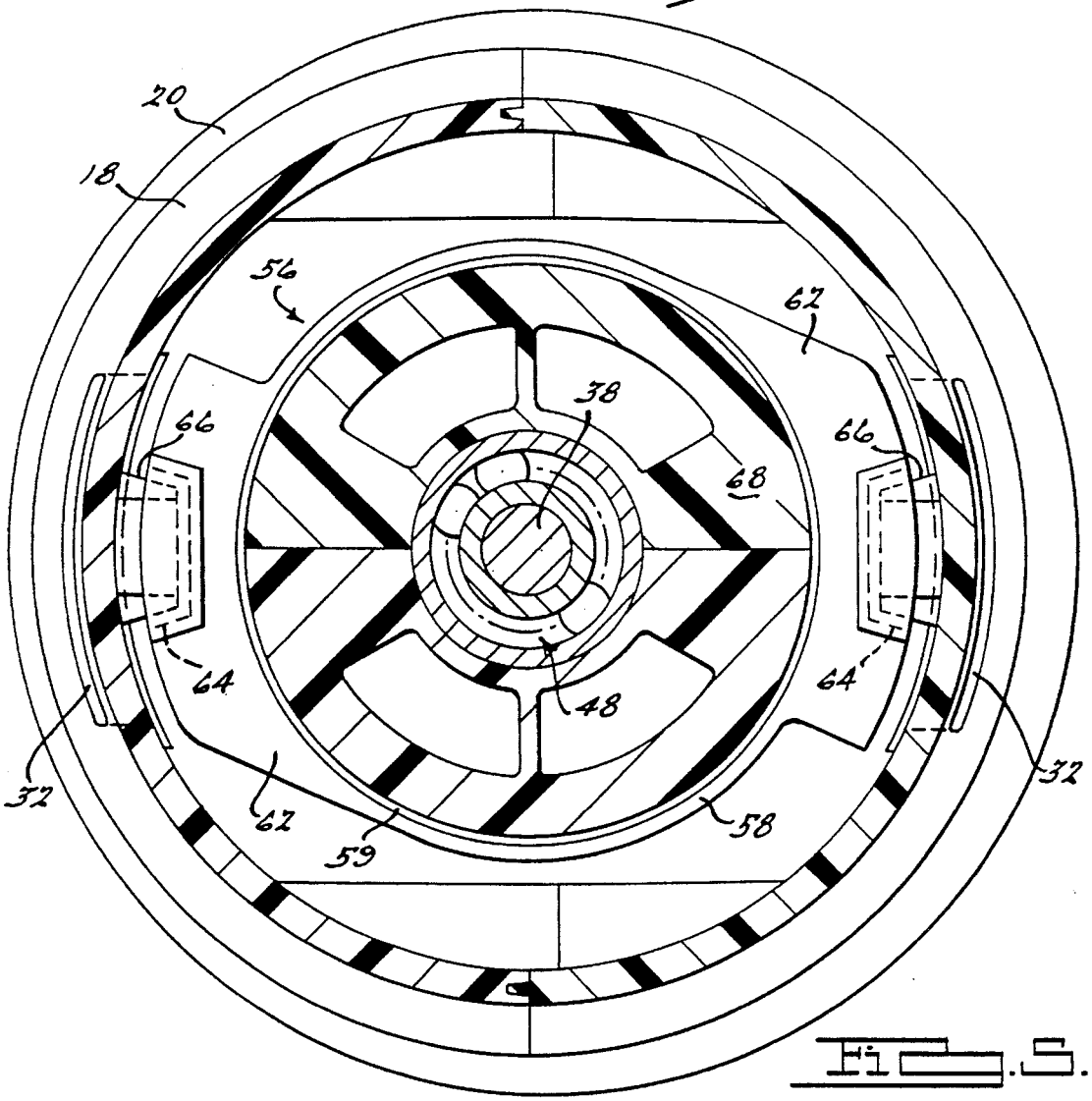

FIG. 5 is a plan view of the baffle of FIGS. 2–4 in assembly relation with the shroud of the sander in accordance with section line 5—5 in FIG. 2, understanding that the platen has not been illustrated in FIG. 5.

DETAILED DESCRIPTION OF THE PREFERRED EMBODIMENTS

Figure 1:
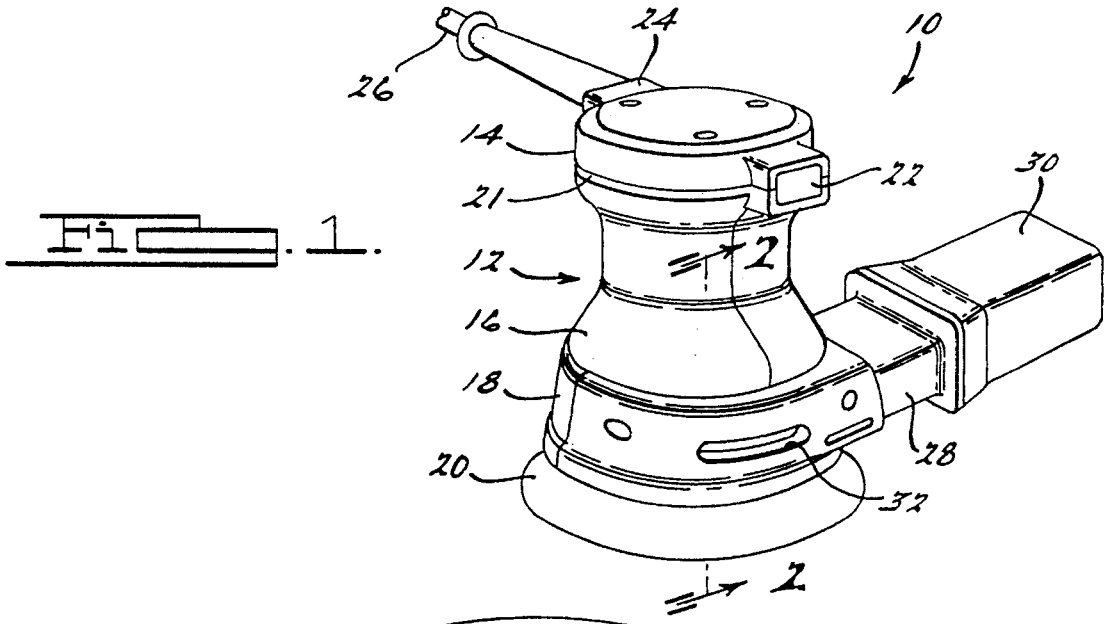
FIG. 1 is an elevational perspective view of a random orbit sander with which the baffle of the present invention is used.

Referring to FIG. 1, there is shown a random orbit sander 10 with which a preferred embodiment of the present invention may be used. The sander 10 generally includes a housing 12 having a two-piece clam shell construction, with the two-pieces thereof held together when assembled by a single-piece top member 14. The housing 12 further includes a lower portion 16 having a two-piece shroud 18 rotatable relative to the housing 12 and secured thereto. The sander 10 further includes a platen 20 driven in a random orbital fashion by a motor (not shown) disposed within the housing 12, and a fan (not shown) driven by the motor. The top member 14 of the housing 12 includes a series of inlets 21 through which a cooling ambient airflow may be drawn into an interior area of the housing 12, an on/off power button 22 and a neck portion 24 through which a power cord 26 coupled to the motor may extend to supply electrical current to the motor. The shroud 18 is removably coupled to a neck portion 28 of a dust bag 30. The shroud 18 further includes a plurality of diametrically opposed outlet (i.e., exhaust) slots 32 (only one being shown) through which the cooling ambient airflow drawn in through the inlets 21 into an interior area of the shroud 18 by the fan may be exhausted from the shroud 18.

The sander 10 is operated by grasping the top member 14 with a hand, and typically with the palm of a hand, and turning on the motor via the on/off switch 22. The dust bag 30 may be rotated with the other hand into a position so that the sander 10 can be conveniently used on a work surface. Once turned on, the motor within the sander 10 drives the platen 20 in a random orbital fashion.

Referring now to FIG. 2, the motor can be seen and is denoted by reference numeral 34. An armature 36 of the motor is operably coupled to a shaft 38, which is in turn fixedly secured to the fan, denoted by reference numeral 40, in part by a threaded screw 42. The platen 20 is also operably secured to the shaft 38 via a plurality of threaded screws 44 (only one being shown) extending through a corresponding plurality of openings 45 in the platen 20 and an eccentrically disposed bearing 46. The bearing 46 causes a random orbital movement of the platen 20 in response to driving rotation of the shaft 38. A second bearing 48 helps maintain the shaft 38 in longitudinal alignment with the axial center of the housing 34 in spite of the forces created by driving the platen 20 eccentrically relative to the shaft 38. Rotation of the shroud 18 is enabled by engagement of a lip **18*a* of the shroud 18 within a channel 16*a* formed in the lower end portion 16 of the housing 12**.

With further reference to FIG. 2, the fan 40 includes a downwardly projecting plurality of blades 50 and an upwardly projecting plurality of blades 52. The downwardly projecting plurality of blades 50 enable the fan 40 to create a suction force when the motor 34 is operated which causes air to be drawn in through openings 54 in the platen 20 and into the dust bag 30 (FIG. 1). In this manner the fan 40 helps to pick up sanding dust off of the work surface. The upwardly projecting fan blades 52 of the fan 40 create a suction force to draw a cooling ambient airflow in through the inlets 21 in the top member 14, down around the motor 34, through the interior of the housing 12, into the interior area of the shroud 18, and outwardly through the outlet slots 32 in the shroud 18. In this manner, the upwardly projecting fan blades 52 operate to generate a cooling airflow when the motor 34 is turned on to help maintain the motor 34 relatively cool during operation of the sander 10.

Referring now to FIGS. 2–4, a baffle 56 in accordance with a preferred embodiment of the present invention will now be described. With initial reference to FIGS. 3 and 4, the baffle 56 includes a main body portion 58 which forms an annular opening 60. The main body portion 58 further includes a generally planar top surface 59, a downwardly depending wall portion 61 for at least partially enclosing the fan 40, and a pair of diametrically opposed neck portions 62. Each of the neck portions 62 has a width approximately equal to the width of each of the outlet slots 32 and further includes a recessed portion 64, the function of which will be described momentarily.

With brief reference to FIGS. 2 and 5, the shroud 18 further includes a pair of inwardly projecting shoulder portions 66 which are diametrically opposed from one another, and approximately centered over each of the openings 32 in the shroud 18. The lower portion 16 of the housing 12 further includes a generally circular boss portion 68 and a generally planar lower face surface 70. The baffle 56 is coupled to the housing 12 during assembly by placing it over the generally circular boss portion 68 such that the boss portion 68 extends through the annular opening 60 (shown in FIG. 3). When assembled, the top surface 59 is in abutting contact with the lower face surface 70. The baffle 56 is thus free to rotate about the boss portion 68 of the housing 12.

With further reference to FIGS. 2–5, the recessed portions 64 in the neck portions 62 of the baffle 56 interengage with the inwardly protruding shoulder portions 66 of the shroud 18 to prevent rotational movement of the baffle 56 relative to the shroud 18, as shown particularly well in FIGS. 2 and 5. Accordingly, the baffle 56 is caused to rotate in accordance with rotational movement of the shroud 18 relative to the housing 12 but is not free to rotate relative to the shroud 18. In this manner the neck portions 62 are always maintained in alignment with the outlet slots 32 of the shroud 18.

With further reference to FIGS. 2–4, the baffle 56 helps to provide a better-defined airflow exhaust path for ambient cooling airflow that is drawn in through the inlets 21 in the top member 14. The baffle 56 enables the cooling air flow to be effectively exhausted from the interior area of the shroud 18, to thus help to better cool the motor 34. Since ambient air drawn in through the inlets 21 is not free to circulate within the complete interior area of the shroud 18, the suction force generated by the fan 40 is increased, thus further helping to cool the motor 34. Additionally, since the baffle 56 is not free to rotate relative to the shroud 18, but is rather interengaged with the shroud 18 such that the neck portions 62 are always aligned with the outlet slots 32 in the shroud 18, the shroud 18 may be rotated by the user to a convenient position when using the sander 10 without affecting the alignment of the baffle 56 relative to the shroud 18. Thus, the baffle 56 does not adversely affect convenient operation of the sander 10 by the user.

The baffle 56 may be constructed from a wide variety of methods, but is preferably injection molded from a suitably strong plastic. In this manner the baffle 56 is advantageously formed as a relatively inexpensive, single piece component. The uniquely simple but effective design of the baffle 56 further allows it to be assembled with the sander 10 during assembly of the sander 10 without significantly complicating the assembly process or otherwise adding appreciably to the overall cost of the sander 10. It will be appreciated, however, that the baffle of the present invention could alternatively be integrally formed within the interior of the shroud 18, if so desired. At present, however, it is expected that manufacturing of the baffle 56 as an independent component will be more cost effective than manufacturing it as an integral part of the shroud 18.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. For a random orbit sander having a housing having a member with an airflow inlet near an upper end of said housing, a rotatable shroud positioned at a lower end thereof having an airflow outlet, a motor disposed within the housing, and a fan coupled to the motor for drawing a cooling airflow in through the airflow inlet, around the motor, and into an interior area of the shroud, the improvement comprising:

a baffle disposed within said shroud for movement relative to said housing for directing said shroud to an ambient environment;

said baffle including at least one neck portion extending so as to register with said airflow outlet in said shroud; and wherein said baffle includes means for interengaging with said shroud such that rotational movement of said shroud causes a corresopnding rotational movement of said baffle.

2. The baffle of claim 1, wherein said baffle is integrally formed from plastic as a single piece component.

3. For a random orbit sander having a housing having a member with at least one airflow inlet, a rotatable shroud portion at a lower end thereof having an airflow outlet, a motor disposed within said housing and coupled to a fan for drawing a cooling airflow in through said inlet, around said motor and outwardly through said outlet in said shroud, the improvement comprising:

an air-directing baffle disposed about a lower portion of said housing of said sander so as to be free to rotate relative to said housing;

said baffle comprising at least one neck portion for registering with said outlet in said shroud; and said baffle including means for engaging said shroud such that said baffle is caused to rotate in accordance with rotation of said shroud when said shroud is rotated relative to said housing;

whereby said baffle operates to define an exhaust airflow path within said shroud to efficiently exhaust said cooling airflow drawn in through said inlet outwardly through said outlet in said shroud.

4. The baffle of claim 3, wherein said means for engaging said shroud comprises a recess formed in said neck portion for engaging a shoulder portion protruding inwardly from an interior of said shroud.

5. The baffle of claim 3, further comprising a side wall portion adapted to partially circumscribe said fan.

6. The baffle of claim 3, wherein said baffle further comprises a generally annular opening and a generally planar top surface, said generally annular opening adapted to fit over a protruding boss portion on said lower end of said housing and said generally planar top surface being adapted to facilitate rotational movement of said baffle concurrently with said shroud relative to said housing.

7. For a random orbit sander having a housing having a top member, an airflow inlet in the top member, a motor disposed within the housing, a fan coupled to the motor, a shroud rotatable relative to the housing at a lower end portion of the housing, the shroud having an exhaust outlet to permit a cooling airflow drawn in through the inlet in the top member, through the housing and into an interior area of the shroud by the fan to be exhausted out of the outlet in the shroud, an air-directing baffle for providing an exhaust airflow path within the interior area of the shroud to more effectively exhaust the cooling airflow out through the outlet in the shroud, the baffle comprising:

an annular main body portion;

first and second neck portions protruding outwardly of said main body portion approximately circumferentially opposite one another;

each said neck portion including a recess for engaging with a protruding shoulder portion on an inner wall of said shroud to thereby cause said baffle to be interengaged with said shroud such that rotational movement of said shroud relative to said housing causes a corresponding rotational movement of said baffle relative to said housing and prevents rotational movement of said baffle relative to said shroud; and a generally flat top surface for abuttingly engaging a lower face surface of said lower end portion of said housing;

whereby said baffle operates to exhaust said cooling airflow drawn into said interior area of said shroud outwardly through said exhaust outlet in said shroud.

8. The apparatus of claim 7, wherein said baffle is integrally formed from plastic.

9. The baffle of claim 7, wherein a width of said neck portion is approximately equal to a width of said opening in said shroud.

10. For a random orbit sander having a housing having a top member, at least one airflow inlet in said top member, a motor disposed within the housing, a shaft coupled to the motor and extending towards a lower portion of the housing, a fan operably coupled to the shaft disposed adjacent the lower portion of the housing, and a shroud for enclosing the fan, the shroud being disposed for rotational movement about the lower portion of the housing relative to the housing, the shroud having a plurality of exhaust outlets for allowing cooling air drawn in through the inlet in the top member and into an interior area of the shroud by the fan during operation of the motor to be exhausted from the shroud, the improvement comprising:

a baffle adapted to engage said lower portion of said housing and to interengage an inner shoulder portion of said shroud so as to be rotatable with said shroud relative to said housing but restricted against rotational movement relative to said shroud;

said baffle including:

a main body portion defining an annular opening, said annular opening adapted to receive a generally circular lower boss portion of said housing to maintain said baffle generally centered about a central vertical axis extending through said housing;

a pair of neck portions protruding diametrically opposite one another, each said neck portion including a recessed portion for engaging with said inner shoulder portion of said shroud to thereby cause said baffle to be rotated in accordance with rotation of said shroud when said shroud is rotated relative to said housing, each of said neck portions extending so as to register with one of said exhaust outlets in said shroud; and said main body portion including a downwardly depending wall portion for at least partially enclosing said fan and for helping to direct said airflow generated by said fan out of said shroud through said exhaust outlets in said shroud, to thereby help exhaust said airflow more effectively out of said shroud.

11. For a random orbit sander having a housing having a member with an airflow inlet near an upper end of said housing, a rotatable shroud positioned at a lower end thereof having an airflow outlet, a motor disposed within said housing and a fan coupled to the motor for drawing a cooling airflow in through the airflow inlet, around the motor and into an interior area of said shroud, the improvement comprising:

a baffle disposed within said shroud for rotational movement relative to said housing, said baffle having at least one neck portion extending so as to register with said outlet in said shroud, and means for interengaging with said shroud such that rotational movement of said shroud causes a corresponding rotational movement of said baffle.

12. A random orbit sander comprising:

a housing having a member with an airflow inlet near an upper end of said housing;

a rotatable shroud positioned at a lower end of said housing and having an airflow outlet;

a motor disposed within said housing;

a fan coupled to said motor for drawing a cooling airflow in through said airflow inlet, around said motor and into an interior area of said shroud;

an airflow directing member disposed within said shroud for directing said cooling airflow entering said shroud outwardly through said airflow outlet in said shroud to an ambient environment; and said airflow directing member being disposed within said shroud so as to be moveable with said shroud to thereby continuously direct said cooling airflow out of said airflow outlet in said shroud regardless of the rotational position of said shroud relative to said housing.

13. The random orbit sander of claim 12, wherein said airflow directing member comprises a baffle having at least one neck portion extending into registration with said airflow outlet in said shroud; and at least one of said shroud and said baffle having a member adapted to engage with the other to cause said baffle to rotate concurrently with said shroud, to thereby maintain said neck portion in registration with said airflow outlet in said shroud.

14. A random orbit sander comprising:

a housing having an airflow inlet near an upper end thereof;

a shroud rotatably mounted to a lower end of said housing, said shroud having at least one airflow outlet formed therein;

a motor disposed within said housing;

a switch for turning on and off said motor;

a fan coupled to an output shaft of said motor for drawing a cooling airflow in through said airflow inlet, around said motor and into an interior area of said shroud; and an airflow directing member disposed within said interior area of said shroud in registration with said airflow outlet and moveable rotationally in accordance with said shroud such that said airflow directing member remains in registration with said airflow outlet when said shroud is rotated during use of said sander, said airflow directing member operating to direct said cooling airflow into said interior area of said shroud and to exhaust said cooling airflow outwardly through only said airflow outlet in said shroud.

15. The random orbit sander of claim 14, wherein said shroud includes a first portion protruding into said interior area thereof and said airflow directing member includes a second portion, said first and second portions positioned so as to interengage with one another during assembly of said random orbit sander such that said airflow directing member rotates in accordance with rotational movement of said shroud.

* * * * *

UNITED STATES PATENT AND TRADEMARK OFFICE

CERTIFICATE OF CORRECTION

PATENT NO. : 5,580,302

DATED : December 3, 1996

INVENTOR(S) : Thomas J. Howard, Jr. et al.

It is certified that error appears in the above-indentified patent and that said Letters Patent is hereby corrected as shown below:

Column 5, line 32, claim 1, after "said" (second occurrence), insert --cooling airflow entering said shroud outwardly through said air flow outlet in said--.

Signed and Sealed this

Eighteenth Day of March, 1997

*Attest:*

Bruce Lehman

BRUCE LEHMAN

*Attesting Officer*

*Commissioner of Patents and Trademarks*